US008854161B2

(12) United States Patent
Chen et al.

(10) Patent No.: US 8,854,161 B2
(45) Date of Patent: Oct. 7, 2014

(54) WIDEBAND FREQUENCY TUNABLE RING RESONATOR

(75) Inventors: Jian Xin Chen, Nantong (CN); Li Heng Zhou, Nantong (CN); Hui Tang, Nantong (CN); Zhi Hua Bao, Nantong (CN); Yong Jie Yang, Nantong (CN); Quan Xue, Hong Kong (HK)

(73) Assignee: Nantong University, Nantong (CN)

( * ) Notice: Subject to any disclaimer, the term of this patent is extended or adjusted under 35 U.S.C. 154(b) by 538 days.

(21) Appl. No.: 13/239,426

(22) Filed: Sep. 22, 2011

(65) Prior Publication Data

US 2012/0256710 A1 Oct. 11, 2012

(30) Foreign Application Priority Data

Apr. 11, 2011 (CN) ..... 2011 1 0090054

(51) Int. Cl.
*H01P 7/08* (2006.01)

(52) U.S. Cl.
CPC ..... *H01P 7/088* (2013.01)
USPC ..... 333/235

(58) Field of Classification Search
CPC ..... H01P 1/20381; H01P 7/088
USPC ..... 333/174, 219, 235
See application file for complete search history.

(56) References Cited

U.S. PATENT DOCUMENTS

| | | | | |
|---|---|---|---|---|
| 6,381,478 | B2 * | 4/2002 | Enokihara et al. | 505/210 |
| 7,525,711 | B1 * | 4/2009 | Rule et al. | 359/244 |
| 2009/0256654 | A1 * | 10/2009 | Chang et al. | 333/205 |

* cited by examiner

*Primary Examiner* — Benny Lee
*Assistant Examiner* — Rakesh Patel

(57) ABSTRACT

The present invention provides a wideband frequency tunable ring resonator, wherein, comprises a closed $\lambda_g/2$ transmission line and two variable capacitors with tunable capacitance, the $\lambda_g/2$ transmission line is axisymmetric around a central line, first ends of the two variable capacitors are respectively connected to two intersection points of the $\lambda_g/2$ transmission line and the central line, the second ends of the two variable capacitors are respectively grounded. By implementing the technical solution of present invention, following technical effects are obtained. The fundamental resonant frequency ($f_{fund}$) can be shifted up and down by controlling the respective values of the two loading capacitors, resulting in a bi-directional tuning of $f_{fund}$. As a result, the tuning range of this invention can be approximately doubled as compared with the conventional tunable ring resonator.

5 Claims, 3 Drawing Sheets

WIDEBAND FREQUENCY TUNABLE RING RESONATOR

FIELD OF THE INVENTION

The present invention relates to wireless communication device, more particularly, to a wideband frequency tunable ring resonator.

BACKGROUND OF THE INVENTION

Recently, tunable or reconfigurable microwave devices have no doubt drawn much attention due to their increasing importance in improving the performances of the current and future wireless communication systems. In response to this requirement, various kinds of frequency-tuning techniques, such as RF MEMS, semiconductor diode, ferroelectric material and so on, have been developed and applied in the designs of microwave tunable circuits and components. Among them, varactor diode is widely used to tune the operation frequency due to its high tuning speed and reliability.

As well known, tunable transmission line resonator has played an essential and key role in the development of tunable microwave components and circuits. Being widely used in many practical designs, tunable one guided-wavelength ($\lambda_g$) ring resonator is one of the notable examples. Besides study and application of itself, derived from which, a $\lambda_g/2$ resonator of open-ended or short-ended is also widely studied and applied, and become a key component of the designs of microwave circuits. Nevertheless, as can be seen from the previous publications, no matter where the loading capacitors are placed along or no matter how many capacitors are attached to the ring resonator, the tuning range of the fundamental resonant frequency ($f_{fund}$) is always $f_0 \rightarrow f_0$ where $f_0$ is the fundamental resonant frequency of the initial-state ring resonator. The operation principle is that $f_{fund}$ is generally shifted down as the loading capacitances are increased. Obviously, the limited tuning bandwidth of $f_{fund}$ will become a problematic issue in the tunable and reconfigurable wireless systems, which needs to be addressed.

SUMMARY OF THE INVENTION

One aspect of present invention is to provide a frequency tunable ring resonator so as to overcome technical problem of limited tuning bandwidth of $f_{fund}$ for the above mentioned resonator in prior art.

A wideband frequency tunable ring resonator, wherein, comprises a closed $\lambda_g/2$ transmission line and two variable capacitors with tunable capacitance, the $\lambda_g/2$ transmission line is axisymmetric around a central line, first ends of the two variable capacitors are respectively connected to two intersection points of the $\lambda_g/2$ transmission line and the central line, the second ends of the two variable capacitors are respectively grounded.

In the wideband frequency tunable ring resonator according to present invention, the closed $\lambda_g/2$ transmission line is connected as a square.

In the wideband frequency tunable ring resonator according to present invention, the closed $\lambda_g/2$ transmission line is connected as a circle.

In the wideband frequency tunable ring resonator according to present invention, the variable capacitor comprises a varactor diode and a DC block capacitor connected in series.

In the wideband frequency tunable ring resonator according to present invention, the variable capacitor is a semiconductor diode or a semiconductor transistor with capacitance varying functions.

In the wideband frequency tunable ring resonator according to present invention, the closed $\lambda_g/2$ transmission line is a $\lambda_g/2$ microwave transmission line.

In the wideband frequency tunable ring resonator according to present invention, the $\lambda_g/2$ microwave transmission line is a $\lambda_g/2$ microstrip line, $\lambda_g/2$ coplanar waveguide, or a $\lambda_g/2$ slot line.

By implementing the technical solution of present invention, following technical effects are obtained.

1. $f_{fund}$ can be shifted up and down by controlling the respective values of the two loading capacitors, resulting in a bi-directional tuning off $f_{fund}$. As a result, the tuning range of this invention can be approximately doubled as compared with the conventional tunable ring resonator.

2. Although the tuning range of $f_{fund}$ can be very wide, there still is no other resonance appears in this range, in such a way the validity of the tuning range of the fundamental resonant frequency is guaranteed.

3. The present invention employs capacitor loading technology, and changes the effective electrical length of the resonator by loading capacitor, so academic analyse, design and machining can be implemented conveniently.

BRIEF DESCRIPTION OF THE DRAWINGS

Hereinafter, embodiments of present invention will be described in detail with reference to the accompanying drawings, wherein.

Figure 5:
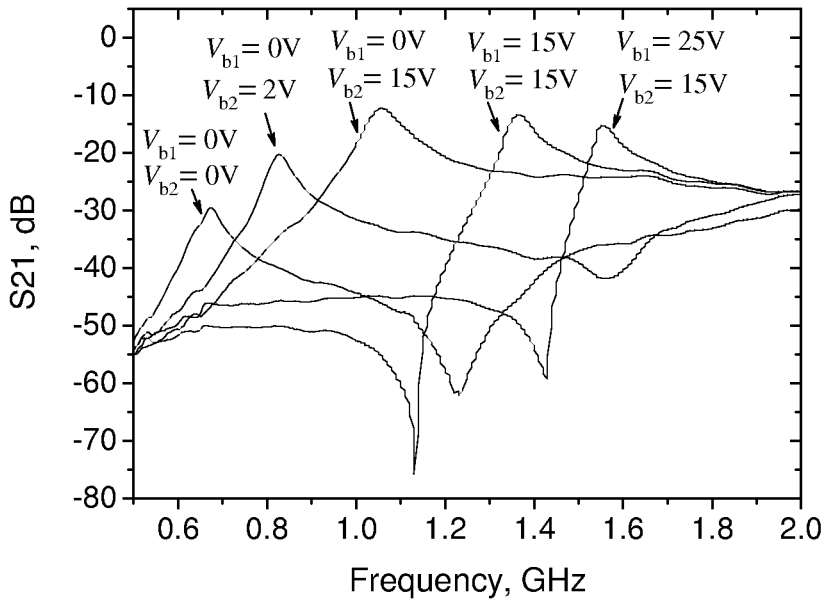

FIG. **4*a*** is an equivalent circuit diagram of the first capacitor $C_1$ of the first embodiment of the wideband frequency tunable ring resonator according to present invention, when testing;

FIG. **4*b*** is an equivalent circuit diagram of the second capacitor $C_2$ of the first embodiment of the wideband frequency tunable ring resonator according to present invention, when testing;

FIG. 5 is a graph of the actually measured frequency response of the wideband frequency tunable ring resonator according to present invention.

DETAILED DESCRIPTION OF THE PREFERRED EMBODIMENT

Figure 1:
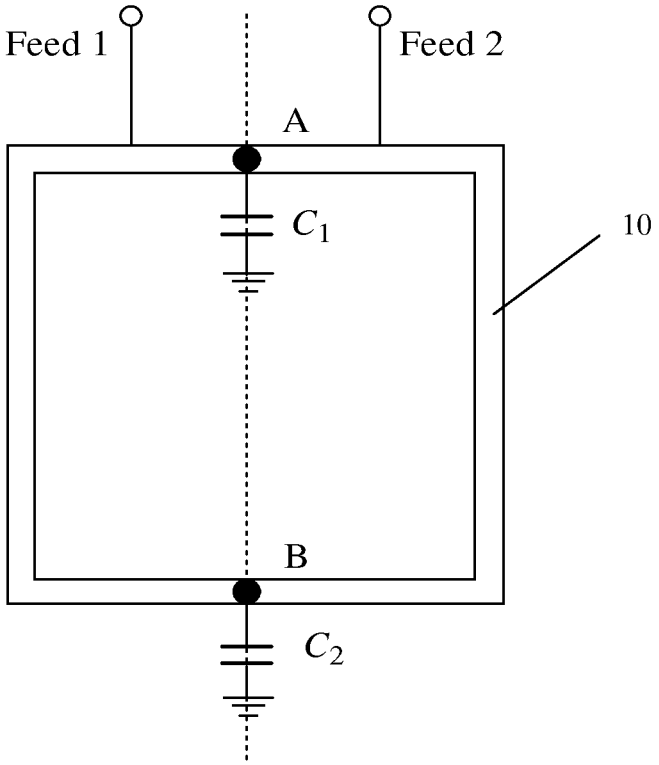
FIG. 1 is a schematic diagram of the first embodiment of the wideband frequency tunable ring resonator according to present invention.

As shown in FIG. 1, in the schematic diagram of the first embodiment of the wideband frequency tunable ring resonator according to present invention, the ring resonator comprises a closed $\lambda_g/2$ transmission line 10 and two variable capacitors $C_1$, $C_2$ with tunable capacitance. The $\lambda_g/2$ transmission line 10 is symmetrical to a central line. The length of the transmission line at the two sides of the central line both are $\lambda_g/4$. In present embodiment, the closed $\lambda_g/2$ transmission line 10 is connected as a square. It should be noted that, this is just an embodiment of present invention, and does not intend to limit the scope of present invention. The $\lambda_g/2$ transmission line also can be connected as a circle or other axisymmetric closed forms, such as regular hexagon, regular octagon and so on. The first ends of the two variable capacitors $C_1$, $C_2$ are respectively connected to two intersection points of the $\lambda_g/2$ transmission line and the central line, that is, the first ends of the two variable capacitors $C_1$, $C_2$ are respectively connected to the point A and point B of the $\lambda_g/2$ transmission line. The second ends of the two variable capacitors $C_1$, $C_2$ are respectively grounded.

The work principle of the frequency tunable ring resonator is explained in detail as follows. At first, the odd- and even-mode methods are employed to analyze the frequency tunable ring resonator.

A. Even-Mode Analysis

Figure 2:
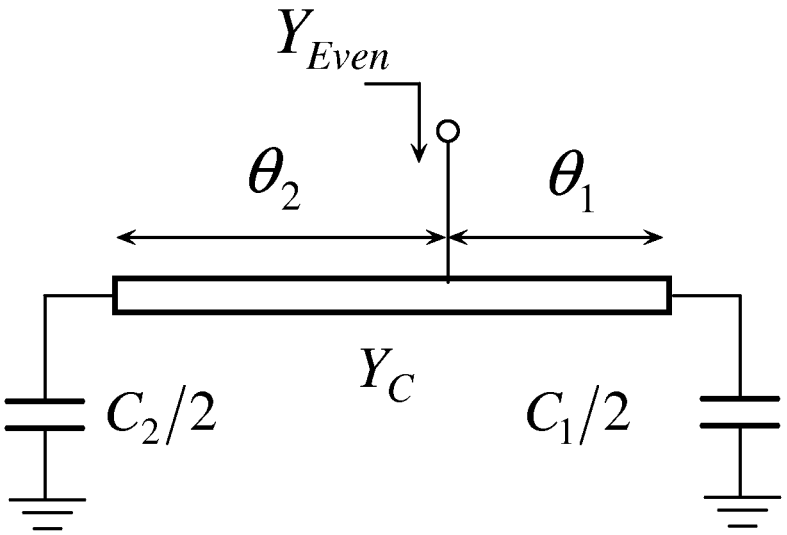
FIG. 2 is an even mode equivalent circuit diagram of the first embodiment of the wideband frequency tunable ring resonator according to present invention.

When the even-mode excitation is applied to the feed ends of the ring resonator (Feed 1 and Feed 2), there is no current flowing through the central line of the ring resonator. Accordingly, we can symmetrically bisect the ring resonator into two loading capacitors to achieve the even-mode equivalent circuit shown in FIG. 2. The input admittance $Y_{even}$ is given by $$Y_{even} = Y_C \cdot \left( \frac{jb_1 + jY_C \tan\theta_1}{Y_C + j(jb_1)\tan\theta_1} + \frac{jb_2 + jY_C \tan\theta_2}{Y_C + j(jb_2)\tan\theta_2} \right). \tag{1}$$

$$b_i = \frac{\omega C_i}{2},\ i = 1 \text{ or } 2 \tag{2}$$

where $Y_C$ and $\theta_j$(j=1 or 2) are the characteristic admittance and the electrical length of the transmission line, respectively.

The initial state of the ring resonator is defined as $C_1=\infty$ and $C_2=0$. Accordingly, the proposed ring resonator can be treated as a short-ended $\lambda_g/2$ ring resonator, and thus the forced mode of the ring resonator is activated. Equation (1) becomes $$Y_{even} = Y_C \cdot \left( \frac{-j}{\tan\theta_1} + j\tan\theta_2 \right) \tag{3}$$

Thus we can obtain the expression of $f_{fund}$ at the initial state $f_0$ $$f_0 = \frac{c}{2L\sqrt{\varepsilon_{eff}}} \tag{4}$$

where c is the velocity of light in free space, $\epsilon_{eff}$ is the effective permittivity, and L is the circumference of the ring resonator.

To investigate the operation principle of the tunable ring resonator, the analysis procedure is divided into two steps.

i. $1^{st}$ step: Changing $C_2$ from 0 to ∞ while fixing $C_1=\infty$ $C_1=\infty$ means $b_1=\infty$, i.e. point A in FIG. 1 is short-circuited, and then the ring resonator becomes a short-ended resonator with centrally-loaded $C_2$. Equation (1) can be simplified to be $$Y_{even} = -j\frac{Y_C}{\tan\theta_1} + Y_C \frac{jb_2 + jY_C \tan\theta_2}{Y_C + j(jb_2)\tan\theta_2} \tag{5}$$

The resonant condition is that the imaginary part of $Y_{even}$ is equal to zero, namely $\mathrm{Im}\{Y_{even}\}=0$, resulting in even, $$b_2(\tan\theta_1 + \tan\theta_2) + Y_C(\tan\theta_1 \tan\theta_2 - 1) = 0 \tag{6a}$$

$$Y_C - b_2 \tan\theta_2 \neq 0 \tag{6b}$$

From (6*a*), we can obtain that $$b_2 = \frac{Y_C(1 - \tan\theta_1 \tan\theta_2)}{\tan\theta_1 + \tan\theta_2} = \frac{Y_C}{\tan(\theta_1 + \theta_2)} \tag{7}$$

Thus the even-mode resonant frequency $f_{even}$ can be expressed as $$f_{even} = \frac{\left[\arctan\left(\frac{Y_C}{b_2}\right) + m\pi\right] \cdot c}{\pi L\sqrt{\varepsilon_{eff}}} \tag{8}$$

where m=0, 1, 2, 3, . . . . From (8), it can be seen that the expression of $f_{even}$ represents $f_{fund}$ (m=0) and its odd-order harmonics. All of them can be tuned as the value of $C_2$ is changed. Since $$0 \le \arctan\left(\frac{Y_C}{b_2}\right) \le \frac{\pi}{2}, \tag{9}$$

the tuning ranges of $f_{fund}$ and its odd-order harmonics can be obtained, as shown in Table I. As $C_2$ is increased from 0 to ∞, $f_{fund}$ is shifted down from $f_0$ to 0 ($f_0 \rightarrow 0$).

TABLE 1

THE TUNING RANGES OF $f_{fund}$ AND ITS ODD-ORDER HARMONICS AS $C_1$ IS DECREASED FROM ∞ TO 0 WHILE $C_2$ = 0 IS FIXED.

| | $f_{fund}$ (m = 0) | $f_{3rd}$ (m = 1) | $f_{5th}$ (m = 2) |
|---|---|---|---|
| Tuning range | $f_0 \rightarrow 0$ | $3f_0 \rightarrow 2f_0$ | $5f_0 \rightarrow 4f_0$ |

$f_{3rd}$: Third harmonic of $f_{fund}$.
$f_{5th}$: Fifth harmonic of $f_{fund}$.

ii. $2^{nd}$ step: Changing $C_1$ from ∞ to 0 while fixing $C_2=0$ $C_2=0$ means $b_2=0$, i.e. there is no loading capacitor at point B in FIG. 2. Thus equation (1) becomes $$Y_{even} = Y_C \frac{jb_1 + jY_C \tan\theta_1}{Y_C + j(jb_1)\tan\theta_1} + jY_C \tan\theta_2 \tag{10}$$

Under the resonant condition $\mathrm{Im}\{Y_{even}\}=0$, there is $$Y_C(\tan\theta_1 + \tan\theta_2) + b_1(1 - \tan\theta_1 \tan\theta_2) = 0 \tag{11a}$$

$$Y_C - b_1 \tan\theta_1 \neq 0. \tag{11b}$$

From (11*a*), $$b_1 = -Y_C \tan(\theta_1 + \theta_2) \tag{12}$$

Accordingly, the expression of even mode resonant frequency $f_{even}$ becomes $$f_{even} = \frac{\left[k\pi - \arctan\left(\frac{b_1}{Y_C}\right)\right] \cdot c}{\pi L\sqrt{\varepsilon_{eff}}} \tag{13}$$

where, k=1, 2, 3, . . . When k=1, $f_{even}$ is corresponding to $f_{fund}$. Since $$\frac{\pi}{2} \le \pi - \arctan\left(\frac{b_1}{Y_C}\right) \le \pi, \tag{14}$$

the tuning ranges off find $f_{fund}$ and its odd-order harmonics can be achieved, as shown in Table II. As $C_1$ is decreased from ∞ to 0, $f_{fund}$ is shifted up from $f_0$ to $2f_0$($f_0 \rightarrow 2f_0$).

TABLE II

THE TUNING RANGES OF $f_{fund}$ AND ITS ODD-ORDER HARMONICS AS $C_1$ IS DECREASED FROM ∞ TO 0 WHILE $C_2$ = 0 IS FIXED.

| | $f_{fund}$ (k = 1) | $f_{3rd}$ (k = 2) | $f_{5th}$ (k = 3) |
|---|---|---|---|
| Tuning range | $f_0 \rightarrow 2f_0$ | $3f_0 \rightarrow 4f_0$ | $5f_0 \rightarrow 6f_0$ |

B. Odd-Mode Analysis

Figure 3:
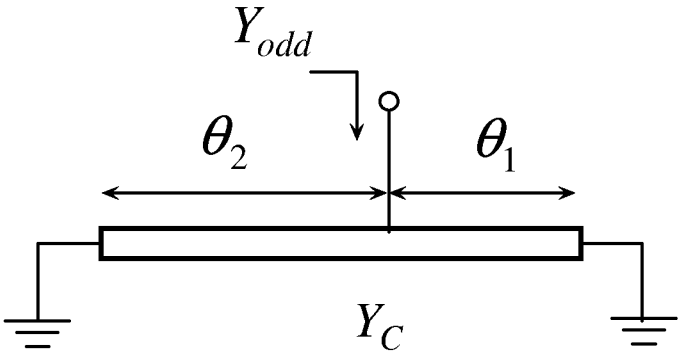
FIG. 3 is an odd mode equivalent circuit diagram of the first embodiment of the wideband frequency tunable ring resonator according to present invention.

When the odd-mode excitation is applied to the feed points of the ring resonator (Feed 1 and Feed 2), there is a voltage null at the center (central line) of the ring resonator. Therefore, the loading capacitors ($C_1$ and $C_2$) have no effect on the odd-mode resonant frequency, and then can be ignored. Accordingly, we can symmetrically bisect the ring resonator into two loading capacitors to achieve the odd-mode equivalent circuit shown in FIG. 3. The input admittance $Y_{odd}$ is given by $$Y_{odd} = -j\frac{Y_C}{\tan\theta_1} - j\frac{Y_C}{\tan\theta_2} \tag{15}$$

Under the resonant condition $\mathrm{Im}\{Y_{odd}\}=0$, there must be $$\theta_1 + \theta_2 = p\pi \tag{16a}$$

$$\theta_1 \text{ or } \theta_2 \neq \frac{(2p-1)\pi}{2} \tag{16b}$$

where p=1, 2, 3, . . . Thus, the odd-mode resonant frequency $f_{odd}$ can be obtained as $$f_{odd} = \frac{pc}{L\sqrt{\varepsilon_{eff}}} \tag{17}$$

From (17), it can be seen that the expression of $f_{odd}$ represents the even-order harmonics off $f_{fund}$, and p=1 is for the second harmonic $f_{2nd}$ of $f_{fund}$. As shown in (17), the operating frequencies of the even-order harmonics can not be tuned by either $C_1$ or $C_2$.

To sum up, $f_{fund}$ can be adjusted bidirectionally around the resonator fundamental resonant frequency $f_o$ at the initial state ($C_1$=∞, $C_2$=0). In theory, the frequency tuning range of the resonator according to present invention reaches $0 \rightarrow 2f_0$, as shown in Table 3, comparing with the traditional tunable resonator (frequency tuning range is $f_0 \rightarrow 0$), the frequency tuning range of the resonator according to present invention is remarkably expanded, as much as twice. Meanwhile, there is no overlap between the frequency tuning ranges of the $f_{fund}$ and its harmonic of the resonator according to present invention, which guarantees the effectively of the wideband tuning range of $f_{fund}$.

TABLE 3

THE TUNING PERFORMANCE OF $f_{fund}$ AND ITS HARMONICS

| | tuning range |
|---|---|
| $f_{fund}$ | $0 \rightarrow 2f_0$ |
| $f_{2nd}$ | fixed ($2f_0$) |
| $f_{3rd}$ | $2f_0 \rightarrow 4f_0$ |
| $f_{4th}$ | fixed ($4f_0$) |
| $f_{5th}$ | $4f_0 \rightarrow 6f_0$ |

Figure 4A:
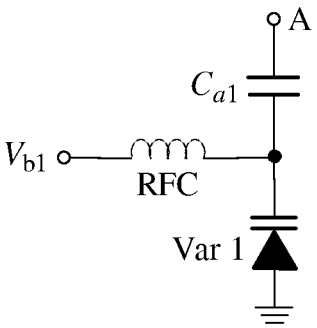
Figure 4B:
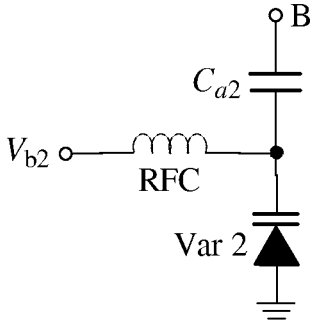

FIGS. 4*a* and 4*b* are respectively equivalent circuit diagrams of the first capacitor $C_1$ and the second capacitor $C_2$ of the wideband frequency tunable ring resonator according to present invention, when testing. Wherein, RFC (RF Choke) is used for isolation between DC bias voltage and RF signal. Varactor diodes Var 1 (Var 2) and ordinary DC block capacitor $C_{a1}$ ($C_{a2}$) connected in series can be used as the variable capacitors $C_1$ and $C_2$. The detail variable capacitance can be expressed by the following formula:

$$C_{ti} = \frac{C_{vi}C_{ai}}{C_{vi} + C_{ai}},\ i = 1 \text{ or } 2 \tag{18}$$

Wherein, $C_{vi}$ represents the capacitance of the varactor diode, and the capacitance changes with the DC bias voltage ($V_{b1}$ and $V_{b2}$). $C_{ai}$ represents the capacitance of the DC block capacitor. As the varactor diodes on the market have various tunable capacitances ranges with different capacitance values, the varactor diode and DC block capacitor should be seriously considered and selected. According to the aforementioned analyse, the initial value of the capacitance of $C_{t2}$ should be as small as possible, so as to approximate the requirement of present invention that $C_2$=0 at the initial state; while the initial value of the capacitance of $C_{t1}$ should be as large as possible, so as to approximate the requirement of present invention that $C_1$=∞ in the initial state. Accordingly, the varactor diode 1SV232 from Toshiba with tunable capacitance 2.9→30 pF is selected for Var 1 and $C_{a1}$=100 pF is chosen, while the varactor diode SMV1233 from Skywork with tunable capacitance 0.84 →5.08 pF is selected for Var 2 and $C_{a2}$=10 pF is chosen.

FIG. 5 is a graph of the actually measured frequency response of the wideband frequency tunable ring resonator according to present invention. It can be known from the Figure that at the initial state, that is, $V_{b1}$=0V and $V_{b2}$=15V, $f_{fund}$=1.06 GHz. When fixing $V_{b1}$=0V, $f_{fund}$ drops down from 1.06 GHz to 0.68 GHz by reducing the value of $V_{b2}$ (15V→0V). In the other hand, when fixing $V_{b2}$=15V fixed, $f_{fund}$ shift up from 1.06 GHz to 1.53 GHz by increasing the value of $V_{b2}$(0V→25V). In such a way, it is validated that the $f_{fund}$ of the resonator according to present invention can be tuned bidirectionally, and the total tuning range reaches 1.25 octaves (0.68 GHz→1.53 GHz).

It should be noted that, in the frequency tunable ring resonator according to present invention, a RF MEM System or a semiconductor diode and semiconductor transistor can be used to realize variable capacitance. In additional, the closed $\lambda_g/2$ transmission line can be a $\lambda_g/2$ microwave transmission line, such as a $\lambda_g/2$ microstrip line, a $\lambda_g/2$ coplanar waveguide, a $\lambda_g/2$ slot line, and so on.

The foregoing description of the exemplary embodiments of the invention has been presented only for the purposes of illustration and description and is not intended to be exhaustive or to limit the invention to the precise forms disclosed. Any modifications and variations are possible in light of the above teaching without departing from the protection scope of the present invention.

What is claimed is:

1. A wideband frequency tunable ring resonator, comprising a closed $\lambda_g/2$ transmission line and two variable capacitors with tunable capacitance, wherein the $\lambda_g/2$ transmission line is axisymmetric around a central line, first ends of the two variable capacitors are respectively connected to two intersection points of the $\lambda_g/2$ transmission line and the central line, second ends of the two variable capacitors are respectively grounded; wherein each of the two capacitors comprises a varactor diode and a DC block capacitor connected in series.

2. The wideband frequency tunable ring resonator according to claim 1, wherein the closed $\lambda_g/2$ transmission line is connected as a square.

3. The wideband frequency tunable ring resonator according to claim 1, wherein the closed $\lambda_g/2$ transmission line is connected as a circle.

4. The wideband frequency tunable ring resonator according to claim 1, wherein the $\lambda_g/2$ transmission line is a $\lambda_g/2$ microwave transmission line.

5. The wideband frequency tunable ring resonator according to claim 4, wherein the $\lambda_g/2$ microwave transmission line is a $\lambda_g/2$ microstrip line, a $\lambda_g/2$ coplanar waveguide, or a $\lambda_g/2$ slot line.

* * * * *